US006887636B2

(12) United States Patent
Matsuda et al.

(10) Patent No.: US 6,887,636 B2
(45) Date of Patent: May 3, 2005

(54) TONER FOR TWO-COMPONENT DEVELOPER, IMAGE FORMING METHOD AND DEVICE FOR DEVELOPING ELECTROSTATIC LATENT IMAGE

(75) Inventors: Hiroaki Matsuda, Numazu (JP); Kazuyuki Yazaki, Numazu (JP); Takayuki Koike, Numazu (JP); Koji Suzuki, Yokohama (JP); Tadashi Kasai, Tokyo (JP); Yutaka Takahashi, Yokohama (JP); Mitsuo Aoki, Numazu (JP); Naohito Shimota, Sunto-gun (JP); Akihiro Itoh, Sendai (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 10/158,069

(22) Filed: May 31, 2002

(65) Prior Publication Data

US 2003/0104297 A1 Jun. 5, 2003

(30) Foreign Application Priority Data

May 31, 2001 (JP) ..... 2001-164364
Jul. 25, 2001 (JP) ..... 2001-225006

(51) Int. Cl.[7] ..... G03G 9/097

(52) U.S. Cl. ..... 430/108.1; 430/108.4; 430/110.3; 430/111.4; 430/120

(58) Field of Search ..... 430/108.1, 108.4, 430/110.3, 111.4, 120, 108.3

(56) References Cited

U.S. PATENT DOCUMENTS 4,562,136 A 12/1985 Inoue et al.
4,590,141 A 5/1986 Aoki et al.
4,908,290 A 3/1990 Watanabe et al.
4,933,250 A 6/1990 Nakayama et al.
4,956,258 A 9/1990 Watanabe et al.
4,980,258 A 12/1990 Aoki et al.
5,061,588 A 10/1991 Fushimi et al.
5,380,616 A 1/1995 Aoki et al.
5,403,690 A 4/1995 Kuramoto et al.
5,994,016 A 11/1999 Kuramoto et al.
6,004,715 A 12/1999 Suzuki et al.
6,060,201 A 5/2000 Kinoshita et al.
6,120,960 A 9/2000 Aoki et al.
6,221,549 B1 4/2001 Emoto et al.
6,228,550 B1 5/2001 Matsuda et al.
6,255,028 B1 7/2001 Hasegawa et al.
6,303,257 B1 10/2001 Hasegawa et al.
6,335,137 B1 1/2002 Suzuki et al.
6,360,068 B1 3/2002 Kinoshita et al.
6,363,229 B1 3/2002 Shiraishi et al.
6,395,443 B2 5/2002 Kuroda et al.
6,432,589 B1 8/2002 Uchinokura et al.
6,432,590 B1 8/2002 Ueda et al.
6,656,654 B2 * 12/2003 Higuchi et al. ..... 430/108.3

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner for a two-component developer comprising the toner and carrier particles, the developer being used for an oilless fixing-type image forming apparatus comprising a developer carrier rotatable at a linear speed of 360–1,680 mm/sec, and a developer adjusting member extending in a lateral direction parallel to the rotational axis of the developer carrier and disposed adjacent to the developer carrier to define a gap therebetween of 0.3–1.0 mm, said image forming apparatus being operated so that the amount of the developer conveyed by the developer carrier and passing through the gap per 1 second is 5.0–25.0 g per 1 cm of the lateral width of the gap, the toner comprising a wax dispersed therein and the toner having a coefficient of dynamic friction in the range of 0.18–0.45.

38 Claims, 2 Drawing Sheets

TONER FOR TWO-COMPONENT DEVELOPER, IMAGE FORMING METHOD AND DEVICE FOR DEVELOPING ELECTROSTATIC LATENT IMAGE

BACKGROUND OF THE INVENTION

This invention relates to a toner for developing an electrostatic latent image and to a device for developing an electrostatic latent image. The present invention is also directed to an image forming method of an oilless fixing type using the above toner.

An electrographic image forming method using a two-component developer composed of a toner and carrier particles is now widely used for obtaining prints and copies.

In recent years, image forming devices are on the increase which have a cleaner for removing residual toner remaining on a photoconductor drum after transfer of a latent image formed thereon with toner and a recycling unit for returning the toner removed by the cleaner to a developing unit, as one disclosed in Japanese Laid-Open Publication No. S60-41079.

As a toner capable of forming high quality images over a long period of time without deterioration even in a recycling system of a low-temperature fixing type, Japanese Laid-Open Publication No. H07-199538 proposes a toner containing two types of additives, an additive which increases the electrostatic charge amount of the toner and an additive which decreases the electrostatic charge amount of the toner, to improve the fluidity of the toner, and carnauba wax and so on to enhance the releasing property of the toner.

In recent years, many copying machine have a printer function. Such a machine has many opportunities to output only one copy or print, increasing the time during which a developer therein is agitated with respect to the number of copies or prints outputted.

In a developing unit, the agitation of developer gives a large influence to the deterioration thereof. When the developer is drawn up onto a developing roller and the toner and the carrier therein are rubbed with each other in a doctor gap, the temperature of the developer is raised and components of the toner deposit to the peripheral surface of the carrier locally. In an oilless toner, a wax is dispersed to secure fixability and a releasing property of the toner. When heat stress is applied to the developer, too much wax appears on the peripheral surface of the toner and deposits to the peripheral surface of the carrier. In the case where the toner has a negative polarity, when the wax having the same polarity deposits to the carrier, the electrostatic charge amount of the toner is decreased.

As a system for controlling image density, a system which detects the concentration of the toner on a photoconductor with light and controls the amount of the toner contained in the developer according to the detected concentration to control the image density is employed in the image forming apparatuses. When the electrostatic charge amount of the toner is decreased, the system controls to decrease the amount of toner in the developer, so that γ-characteristics can be exhibited up to an intermediate image density region but a saturated image density cannot be obtained.

As a result, there arise problems such as lowering of the image density and insufficient sharpness, and the service life of the developer is considerably shortened.

The problems are typical with high-speed machines in which a developer is passed through a doctor gap of 0.3–1.0 mm so that the thickness of the developer on the developing roller may be constant. The characteristic is dependent on the rotational speed of the developing roller. Normally, the rotational speed of the developing roller is 1.5–3 times that of a photoconductor. In this case, the amount of the developer passing through the doctor gap per 1 second is 5.4–25.2 g per 1 cm of the lateral width of the gap. The above problems occur when the rotational speed of the photoconductor is 240–560 mm/sec, namely, when the amount of developer on the developing roller is 0.15 g/cm$^2$. When the amount of developer passing through the doctor gap is excessively smaller than the lower limit, the stress which the developer receives is too small to cause a problem. When the amount of the developer is excessively larger than the upper limit, the conditions are so bad that it is difficult to solve the problems by improvement of a toner.

SUMMARY OF THE INVENTION

It is, therefore, an object of the present invention to provide a toner for use in a two-component developer which is free from the problems of the prior arts and which is resistant to heat stress and mechanical stress and thus capable of producing a stable image. Another object of the present invention is to provide a method of producing the toner. Still another object of the present invention is to provide an image forming method using a two-component developer containing the toner.

According to one aspect of the present invention, there is provided a toner for a two-component developer comprising the toner and carrier particles, the developer being used for an oilless fixing-type image forming apparatus comprising a developer carrier rotatable at a linear speed of 360–1,680 mm/sec, and a developer regulating member extending in a lateral direction parallel to the rotational axis of the developer carrier and disposed adjacent to the developer carrier to define a gap therebetween of 0.3–1.0 mm, the image forming apparatus being operated so that the amount of the developer conveyed by the developer carrier and passing through the gap per 1 second is 5.0–25.0 g per 1 cm of the lateral width of the gap, the toner comprising a wax dispersed therein and the toner having a coefficient of dynamic friction in the range of 0.18–0.45.

In another aspect, the present invention provides an image forming method of an oilless fixing type, comprising:

- forming an electrostatic latent image on an electrostatic latent image bearable member,
- contacting the latent image on the image bearable member with a developer carried by a developer carrier rotating at a linear speed of 360–1,680 mm/sec,
- wherein the amount of the developer carried on the developer carrier is regulated by a developer regulating member extending in a lateral direction parallel to the rotational axis of the developer carrier and disposed adjacent to the developer carrier to define a gap therebetween of 0.3–1.0 mm,
- wherein the amount of the developer carried on the developer carrier and passing through the gap per 1 second is 5.0–25.0 g per 1 cm of the lateral width of the gap, and
- wherein the developer comprises carrier particles and the above toner.

The present invention further provides a device for developing a latent image on an image bearable member, comprising a developer carrier rotatable at a linear speed of 360–1,680 mm/sec and disposed such that the developer carried by the developer carrier may be brought into contact with the latent image on the image bearable member, and a developer regulating member extending in a lateral direction parallel to the rotational axis of the developer carrier and disposed adjacent to the developer carrier to define a gap therebetween of 0.3–1.0 mm, the developing device being operable so that the amount of the developer conveyed by the developer carrier and passing through the gap per 1 second is 5.0–25.0 g per 1 cm of the lateral width of the gap, the developer comprising carrier particles and the above toner.

In an electrographic high speed machine targeted by the present invention, since 5.0–25.0 g/(cm·sec) of the developer passes through the narrow gap (e.g. doctor gap) between the developer regulating member (e.g. doctor blade) and the developer carrier (e.g. developing roller), a considerable amount of heat is generated by friction and so on as compared with machines of other types. According to the present invention, a stable image can be always obtained by combining the high-speed machine with a toner from which a wax does not ooze out even when the temperature of the toner is raised in passing through the doctor gap. In order to prevent the wax dispersed in the toner from oozing out therefrom, it is believed to be preferable that the wax exists on the peripheral surface of the toner as little as possible.

As a result of zealous studies, the present inventors have accomplished the present invention.

The first, essential feature of the present invention is that a pellet formed by pressing the toner has a coefficient of dynamic friction in the range of 0.18–0.45. When the coefficient of dynamic friction is in the above range, the wax dispersed in the toner does not ooze out therefrom even when the toner receives severe mechanical stress in passing through the doctor gap in the high-speed electrographic image forming apparatus of the present invention. In general, binder resins, of which toners are mostly composed, have a coefficient of dynamic friction of around 0.5 and waxes have a coefficient of dynamic friction of around 0.1. Namely, when a large amount of wax exists on the peripheral surface of the toner, the coefficient of dynamic friction of the toner is lower than 0.18. On the other hand, when an appropriate amount of wax exists on the peripheral surface of the toner, the coefficient of dynamic friction of the toner is within 0.45. When the coefficient of dynamic friction is over 0.45, very little wax exist on the peripheral surface of the toner and fixing offset occurs.

The second, preferred feature of the present invention is that the wax dispersed in the toner is selected from the group consisting of rice wax, ester wax and mixtures thereof. These waxes can be well dispersed when kneaded with other toner ingredients and thus suitable for use in the toner of the present invention.

The third, preferred feature of the present invention is that wax particles having a particle diameter of 100–300 $\mu$m are used. When wax particles having an excessively small particle diameter are used, the diameter of wax particles dispersed in the resulting toner, which is controlled in a process of kneading toner ingredients, will be small, so that a toner from which the wax does not ooze out even when receiving heat stress or mechanical stress can be obtained. Conventionally, wax particles having a particle diameter of around 600 $\mu$m have been generally used for production of a toner. When such wax particles are kneaded with other toner ingredients in a usual manner, the diameter of the wax particles may sometimes become over 10 $\mu$m when dispersed. A toner made from the thus obtained kneaded mixture contains particles mostly composed of the wax. On the other hand, when wax particles having a particle diameter of excessively less than 100 $\mu$m are used, the diameter of wax particles dispersed in the resulting toner becomes so small that low-temperature fixability and offset resistance of the toner may be adversely affected.

The diameter of wax particles dispersed in a toner is obtained by analysis of a photographic image taken using a scanning transmission electron microscope with an image analyzer LUZEX IIIU (manufactured by NIRECO Corporation). In the present invention, the wax particles dispersed in the toner preferably have an average particle diameter of 0.3–1.0 $\mu$m, more preferably 0.3–0.7 $\mu$m. When the average particle diameter of wax particles is excessively larger than 1.0 $\mu$m, the toner particles tend to be broken at the wax particles and the area where the wax exposed on the peripheral surface of the toner is increased. This may promote deterioration of carrier by toner spent. When the average particle diameter is excessively less than 0.3 $\mu$m, the amount of wax which can function for its intended purpose on the peripheral surface of the toner is so small that the low-temperature fixability and offset resistance of the toner may be adversely affected.

Wax particles obtained by spray drying method have a uniform particle diameter distribution and do not include particles having excessively large diameters. Thus, when such wax particles are used, a toner in which the wax is uniformly dispersed can be obtained. This is preferable to the present invention.

The fourth, preferred feature of the present invention is that the toner has a sphericity of at least 0.94. When a toner having a high sphericity is used in a two-component developer, the fluidity of the developer can be maintained at a high level. Thus, even when the developer is conveyed at a high speed by a developing roller, the developer is unlikely to receive stress in passing through the doctor gap due to its high fluidity. By definition, sphericity is 1 at maximum.

The fifth, preferred feature of the present invention is that the toner has a loose apparent density of 0.3–0.5 g/cm$^3$. The loose apparent density of a toner represents the degree of compaction (density) of the toner in a still state. When additives and so on deposit to the peripheral surface of the toner, the fluidity of the toner as a powder is increased and the toner is apt to be compacted. This increases the density of the toner. Thus, a large loose apparent density means that the peripheral surface of the toner is sufficiently covered with inorganic fine powder. Since the peripheral surface of the toner is sufficiently protected by the inorganic fine powder, the toner is less likely to receive stress during its passage through the doctor gap. When the loose apparent density exceeds 0.5 g/cm$^3$, however, an excess inorganic fine powder is present on the peripheral surface of the toner. In this case, the inorganic fine powder is apt to be liberated from the toner and may injure a surface of an image bearable member such as a photoconductor.

An additive that is highly effective in protecting the peripheral surface of the toner may be, for example, alumina having a Mohs hardness of 9, which can protect the peripheral surface of the toner from stress with its great hardness. Inorganic fine powder whose surfaces have been treated with silicon oil also has an effect of protecting the peripheral surface of the toner due to a releasing property peculiar to silicon oil.

The sixth, preferred feature of the present invention is that the toner has an aggregation degree of 30% or less. The aggregation degree of a toner originally represents adhesion among the toner particles, and a high aggregation degree means that a large amount of wax exists on the peripheral surface of the toner. When the aggregation degree is excessively higher than 30%, too much wax exists on the peripheral surface of the toner, so that, when the toner is used in a high speed-machine of the present invention, the wax tends to contaminate the peripheral surface of the carrier. This will adversely affect the triboelectric chargeability of the developer, resulting in lowering of fixability and frequent occurrence of surface stain. The aggregation degree of the toner can be 0%.

The seventh, preferred feature of the present invention is that the toner contains a compound containing zirconium to which at least one aromatic compound selected from the group consisting of aromatic diols, hydroxyl group-containing aromatic carboxylic acids, aromatic monocarboxylic acids and aromatic polycarboxylic acids. It is believed that when the toner contains the above compound even in a small amount, the wax component is metal-crosslinked by the zirconium ions and modified such that it is less likely to contaminate the carrier.

The eighth, preferred feature of the present invention is that the toner is obtained by granulating, in an aqueous medium, a composition comprising the wax and a binder resin or a precursor of the binder resin. In the thus obtained toner, the wax particles are finely divided and dispersed in an inside region of the toner and, thus, are prevented from exposing on the surfaces of the toner. In this case, it is easy to control the coefficient of dynamic friction of the toner to 0.18–0.45. In one preferred embodiment, the granulation in an aqueous medium may be carried out by providing an organic solvent solution or dispersion of a binder resin, wax particles and a colorant, the organic solvent solution or dispersion being then dispersed into an aqueous medium with stirring to obtain resin particles dispersed in the aqueous medium and containing the wax particles and colorant. The resin particles are separated and dried to obtain a toner. In an alternate preferred embodiment, the granulation in an aqueous medium may be carried out dispersing an organic solvent solution or dispersion containing a prepolymer of a binder resin, the wax particles, a colorant and a reactant selected from chain extenders and crosslinking agents, into an aqueous medium with stirring at a temperature sufficient to react the prepolymer with the reactant to obtain toner particles dispersed in the aqueous medium and containing the binder resin, the wax particles and the colorant. The toner particles are then separated and dried.

BRIEF DESCRIPTION OF THE DRAWINGS

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 1:
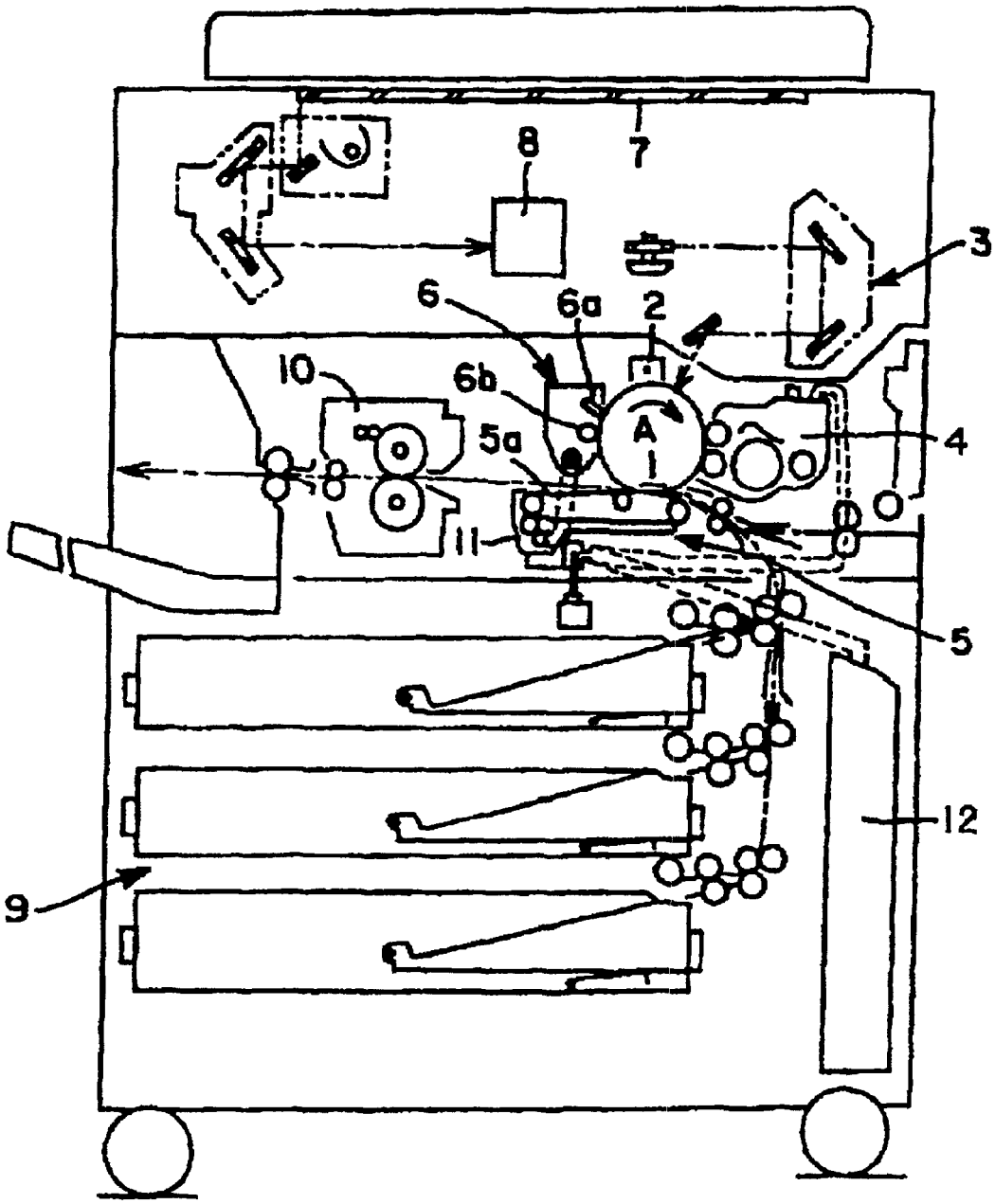
FIG. 1 is a schematic view of a digital copying machine (one example of an image forming apparatus) used in the present invention.

Description will be first made of a toner of the present invention.

The toner of the present invention comprises at least a binder resin and a colorant and contains a wax dispersed therein.

As the wax for use in the present invention, any wax conventionally used in toners can be employed. Preferable among them are carnauba wax, rice wax, ester wax and mixtures thereof, and the use of rice wax, ester wax or mixtures thereof is especially preferred.

Carnauba wax is a natural wax which is obtained from leaves of *Copernicia ceriferab* Martius. For use in the present invention, a free fatty acid-removed type carnauba wax having a low acid value is preferred because it can be uniformly dispersed in a binder resin.

Rice wax is a natural wax which is obtained by purifying slack wax produced in a dewaxing or wintering process to purify rice bran oil extracted from rice bran.

Ester wax is a wax which is synthesized by an esterification reaction of a monofunctional straight-chain fatty acid and a monofunctional straight-chain alcohol.

The waxes may be used alone or in combination. The wax is preferably used in an amount of 0.5–10 parts by weight per 100 parts by weight of resin components of the toner.

As the binder resin for use in the present invention, any resin known to be used conventionally for the preparation of a toner can be employed. Illustrative of suitable binder resins are styrene resins (homopolymers or copolymers containing styrene or its homologues) such as polystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic acid ester copolymer, styrene-methacrylic acid ester copolymer, styrene-α-methyl chloroacrylate copolymer, styrene-acrylonitrile-acrylic acid ester terpolymer; polyester resins, epoxy resins, vinyl chloride resins, rosin-modified maleic acid resins, phenol resins, polyethylene resins, polypropylene resins, petroleum resins, polyurethane resins, ketone resins, ethylene-ethylacrylate copolymer, xylene resins, and polyvinyl butyrate resins. The resins may used alone or in combination.

The method of preparing the binder resin is not specifically limited. The binder resin may be prepared by bulk polymerization, solution polymerization, emulsion polymerization or suspension polymerization.

As the colorant for use in the present invention, any pigment or dye conventionally used as a colorant for preparation of a toner can be employed. Specific examples of the colorant include carbon black, lamp black, iron black, ultramarine blue, Nigrosine dyes, aniline blue, Chalco Oil Blue, oil black and azo oil black.

Color pigments or color dyes may be used to prepare a color toner.

The colorant is preferably used in an amount of 1–10 parts by weight, more preferably 3–7 parts by weight, per 100 parts of the binder resin.

The toner of the present invention may be mixed with an external additive for the purposes of improving the fluidity and so on. Inorganic fine particles may be suitably used as the external additive. Such inorganic fine particles include silica, alumina, titanium oxide, barium titanate, magnesium titanate, calcium titanate, strontium titanate, zinc oxide, tin oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle diameter of 5 mμ (5 nm) to 2 μm, more preferably 5 mμ to 500 mμ, and a BET specific surface area of 20–500 $m^2/g$. The inorganic fine particles are used in an amount of generally 0.01–5% by weight, preferably 0.01–2% by weight, based on the weight of the toner.

The external additive may also be fine particles of a polymeric substance such as polystyrene, polymethacrylate or an acrylate copolymer obtained by soap-free emulsion polymerization, suspension polymerization or dispersion polymerization; silicone, benzoguanamine or nylon obtained by polycondensation; or a thermosetting resin.

By subjecting these external additives (fluidizing agents) to a surface treatment to improve the hydrophobic properties thereof, deterioration of the fluidity and the charge properties of the toner can be avoided even under high humidity conditions. Suitable surface treating agents include silane coupling agents, silylating agents, silane coupling agents having a fluorinated alkyl group, silicon oil, organic titanate type coupling agents, and aluminum type coupling agents.

The toner of the present invention may contain a charge controlling agent, if desired. Any charge controlling agent generally used in the field of toners for use in electrograph may be used. Examples of charge controlling agents include a Nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing activator material, and metal salts of salicylic acid and derivatives thereof.

Specific examples of the charge controlling agents include Bontron 03 (Nigrosine dyes), Bontron P-51 (Quaternary ammonium salts), Bontron S-34 (metal-containing azo dyes), E-82 (oxynaphthoic acid type metal complex), E-84 (salicylic acid type metal complex) and E-89 (phenol type condensation products), which are manufactured by Orient Chemical Industries Co., Ltd.; TP-302 and TP-415 (quaternary ammonium salts molybdenum complex), which are manufactured by Hodogaya Chemical Co., Ltd.; Copy Charge PSY VP2038 (quaternary ammonium salts) Copy Blue PR (triphenylmethane derivatives), Copy Charge NEG VP2036 (quaternary ammonium salts) and Copy Charge NX VP434(quaternary ammonium salts), which are manufactured by Hoechst AG; LRA-901 and LR-147 (boron complex), which are manufactured by Japan Carlit Co.; copper Phthalocyanine; perylene; quinacridone; azo type pigments; and polymer compounds having a functional group such as a sulfonic acid group, a carboxyl group or a quaternary ammonium salt group.

In the present invention, the use of an organic zirconium compound as the charge controlling agent is especially preferred. The organic zirconium compound is a compound containing zirconium to which at least one aromatic compound selected from the group consisting of aromatic diols, hydroxy group-containing aromatic carboxylic acids, aromatic monocarboxylic acids, and aromatic polycarboxylic acids is bonded or coordinated.

Examples of the aromatic diols include hydroquinone and its derivatives. Examples of the hydroxyl group-containing aromatic carboxylic acids include salicylic acid and its derivatives. Examples of the aromatic monocarboxylic acids include benzoic acid and its derivatives. Examples of the aromatic polycarboxylic acids include terephthalic acid, isophthalic acid, trimellitic acid and their derivatives.

The charge controlling agent is preferably used in an amount of 0.1–2.0 parts by weight per 100 parts by weight of the binder resin.

The toner of the present invention may be prepared by a conventionally known method. Namely, the toner of the present invention can be prepared as follows. The binder resin, the colorant, the wax, and, optionally, the charge controlling agent and so on are blended using a mixer. The mixture is kneaded and milled under application of heat. The kneaded mixture is then cooled and solidified and the solidified mixture is finely ground. The ground particles are classified to obtain a toner having a desired average particle diameter.

The temperature at which the mixture is kneaded and milled is preferably not higher than 100° C., more preferably 80–100° C. A temperature over 100° C. is not preferred because the melt viscosity of the binder resin in the toner ingredients is lowered so largely that the wax cannot be finely dispersed in the kneaded mixture. When the temperature is less than 80° C., the melt viscosity of the binder resin becomes so high that a large torque is applied the melt-kneader, which may cause a breakdown thereof.

To mix the inorganic fine particles with the toner, a mixer such as a super mixer or a Henschel mixer may be used.

A carrier mixed with the toner when the toner of the present invention is used as a two-component developer may be fine particles mainly composed of glass, iron, ferrite, nickel, zircon or silica and having a particle diameter in the order of 10–150 $\mu$m. The carrier may be fine particles of the above material each covered with a styrene-acrylic resin, a silicon resin, a polyamide resin, a polyvinylidene fluoride resin or the like.

Especially, the use of a silicon resin-covered carrier is preferred. Since a silicon resin has low surface energy, the wax in the toner is not apt to deposit to the surfaces of the carrier particles. A carrier containing an aminosilane coupling agent is also preferred. Even when the wax deposits to the surfaces of the carrier particles, the developer can maintain stable triboelectric chargeability due to the strong positive polarity of the aminosilane coupling agent.

In a two-component developer, a toner is generally mixed with a carrier in an amount of 3–15 parts by weight per 100 parts by weight of the carrier.

Description will be next made of methods of measuring characteristics of the toner according to the present invention.

1. Coefficient of Dynamic Friction of Toner Surface

A load of 6 $t/cm^2$ is applied to 3 g of a toner, thereby forming the toner into a disk-shaped pellet. The pellet is measured for the coefficient of dynamic friction using an automatic friction abrasion analyzer manufactured by Kyowa Interface Science Kagaku Co., Ltd. At this time, a stainless ball point contact having a diameter of 3 mm is used as the contact.

2. Diameter of Wax Particles

The diameter of wax particles is measured by a method using a vibrating sieve or laser beam. One example of laser method is shown below.

Instrument: particle size distribution measuring device of a laser diffraction/dispersion type, LA-920, manufactured by Horiba Ltd.

Conditions: circulation rate: 5–7 minutes, dispersion medium: methanol

3. Sphericity

A flow particle image analyzer, "FPIA-1000", manufactured by Toa Iyou Denshi K.K. is used for the measurement of sphericity of the toner particles and particles of the external additives.

A few droplets of a nonionic surfactant (preferably Contaminon N, made by Wako Pure Chemical Industries, Ltd.)

is added to water, which has been passed through a filter to remove fine dust and thus contains 20 or less particles having a diameter within the measurement range (a circle-equivalent diameter of not smaller than 0.60 to less than 159.21 μm, for example) per $10^{-3}$ $cm^3$. To the water, 5 mg of a sample is added. This is subjected to a dispersion treatment for 1 minute under conditions of 20 kHz and 50 W/10 $cm^3$ with an ultrasonic disperser UH-50, manufactured by K.K. SMT and then subjected to a dispersion treatment for 5 minutes in total to form a sample dispersion liquid having a concentration of 4000 to 8000 particles/$10^{-3}$ $cm^3$ (based on particles having a circle-equivalent diameter within the measurement range). The sample dispersion liquid is measured for a particle size distribution of particles having a circle-equivalent diameter in a range from not smaller than 0.60 μm to less than 159.21 μm using the above flow type particle image analyzer.

The sample dispersion liquid is passed through a channel (extending along the flow direction) of a flat transparent flow cell (thickness: about 200 μm). A strobe and a CCD camera are disposed at positions opposite to each other with respect to the flow cell to form a light path passing across the thickness of the flow cell. While the sample dispersion liquid is flowing, the strobe is flashed at intervals of 1/30 second to capture images of particles passing through the flow cell, whereby each particle is captured as a two-dimensional image having a certain area parallel to the flow cell. From the area of the two-dimensional image of the particle, a diameter of a circle having the same area is calculated as a circle-equivalent diameter of the particle.

For about one minute, more than 1200 particles can be measured for a circle-equivalent diameter, whereby the number of particles based on a circle-equivalent diameter distribution and a proportion (% by number) of particles having a specified circle-equivalent diameter can be determined. The result (frequency % and cumulative %) can be given in such a manner that the range from 0.06 μm to 400 μm is divided into 226 channels (divided into 30 channels for one octave). In actual measurement, particles are measured within the circle-equivalent diameter range from 0.60 μm to less than 159.21 μm.

4. Loose Apparent Density

A powder tester (PT-N, manufactured by HOSOKAWA MICRON CORPORATION) is used as a measuring instrument. A 246 μm-mesh sieve is set in a vibration table and 250 cc of a sample powder is put on the sieve. The vibration table is vibrated for 30 seconds so as to fill a vessel set under the sieve with the sieved sample powder. Then the upper portion of the sample powder in the vessel is removed with an attached blade so that the surface of the powder may level to the brim of the vessel. The sample powder in the vessel is weighed. This operation is repeated 5 times to obtain an average value. The powder tester PT-N automatically displays the measurement.

$$\text{Loose apparent density} = W(g)/V(cc)$$

wherein W represents the average weight of the powder, and V represents the capacity of the vessel. The capacity of the vessel used for the powder tester PT-N is 100 cc.

5. Particle Diameter

Coulter counter TA-II or Coulter Multisizer II (manufactured by Coulter Electronics Inc.) is used as the measuring instrument. 0.1 to 5 Ml of a surfactant (preferably alkyl benzene sulfonate salt) is added as a dispersant to 100 to 150 ml of an electrolytic solution, which is an about 1% aqueous solution of NaCl prepared using a first-grade sodium chloride such as ISOTON-II (made by Coulter Scientific Japan Co.). 2 to 20 Mg of a sample toner is added to the aqueous solution. The electrolytic solution in which the sample toner is suspended is subjected to dispersion treatment for about 1 to 3 minutes using an ultrasonic disperser. The measuring instrument measures the suspension for the volume and the number of the toner particles using an aperture having a diameter of 100 μm and calculates the volume distribution and the number distribution thereof. From the thus obtained distributions, the volume-average particle diameter (Dv) and the number-average particle diameter (Dn) of the toner can be obtained.

In the measurement, 13 channels, i.e., 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.20–25.40 μm; 25.40–32.00 μm; and 32.00–40.30 μm (the upper limit not included), are used and particles having a diameter of not smaller than 2.00 μm and less than 40.30 μm are measured.

6. Aggregation Degree

The aggregation degree of the toner is measured as follows using a powder tester manufactured by Hosokawa Micron Corporation as the measuring instrument.

Three sieves having an opening of 22 μm, 45 μm and 75 μm, respectively, are set on a vibration table of the powder tester such that a sieve having larger openings is set at an upper position. 10 Gram of a sample toner is put on the uppermost sieve and the vibrating table is vibrated at an amplitude of 1 mm for 30 seconds. The aggregation degree is obtained by the following calculation. Namely, the sum of the following three calculated values (a), (b) and (c) is defined as the aggregation degree.

$$\frac{\text{Weight of toner remained on the upper sieve}}{\text{Weight of sample toner}} \times 100: \quad (a)$$

$$\frac{\text{Weight of toner remained on the middle sieve}}{\text{Weight of sample toner}} \times 100: \quad (b)$$

$$\frac{\text{Weight of powder remained on the lower sieve}}{\text{Weight of sample toner}} \times 100: \quad (c)$$

$$\text{Aggregation degree } (\%) = (a)+(b)+(c)$$

In the image forming method of the present invention, an image is formed under conditions of a linear speed of the developing roller of 0.3–1.0 mm, a doctor gap of 0.3–1.0 mm, preferably 0.3–0.5 mm, and an amount of developer passing through the doctor gap per 1 second of 5.0–25.0 g/per 1 cm of the lateral width thereof, and using a two-component developer containing the toner of the present invention.

In the image forming method of the present invention, a space between the developing roller and the photoconductor (developing gap) is preferably 0.3–1.0 mm, more preferably 0.3–0.5 mm.

The present invention targets a high speed machine having a developing roller rotatable at a linear speed of 360–1680 mm. Thus, when the developing gap is less than 0.3 mm, the stress which the developer receives in passing therethrough is so large that the developer, especially the carrier, is easily deteriorated. When the developing gap is over 1.0 mm, the amount of the developer passing through a developing area is so large that the surface of the photoconductor is damaged. In the image forming method of the present invention, it is preferred to use at least two developing roller. When at least two developing roller are used, the developing area can be easily enlarged, so that a stable image with a high image density can be easily obtained.

Description will be hereinafter made of the preferred embodiment of the present invention with reference to the drawings.

A digital copying machine (image forming apparatus) shown in FIG. 1 employs a well-known electrographic system and has a drum-shaped photoconductor 1. Around the photoconductor 1, a charger 2, exposure means 3, developing means 4, transfer means 5, and cleaning means 6 for performing electrographic copying process are disposed along the rotating direction of the photoconductor 1 shown by the arrow A.

Reading means 8 reads a draft placed on a draft table 7 disposed on an upper side of the copying machine as an image signal and the exposure means 3 forms an electrostatic latent image on the photoconductor 1 based on the image signal.

The electrostatic latent image formed on the photoconductor 1 is developed into a toner image by the developing means 4 and the toner image is electrostatically transferred onto a transfer paper fed from a paper supply unit 9 by the transfer means 5. The transfer paper bearing the toner image is transported to fixing means 10 and discharged after the toner image has been fixed thereon.

Figure 2:
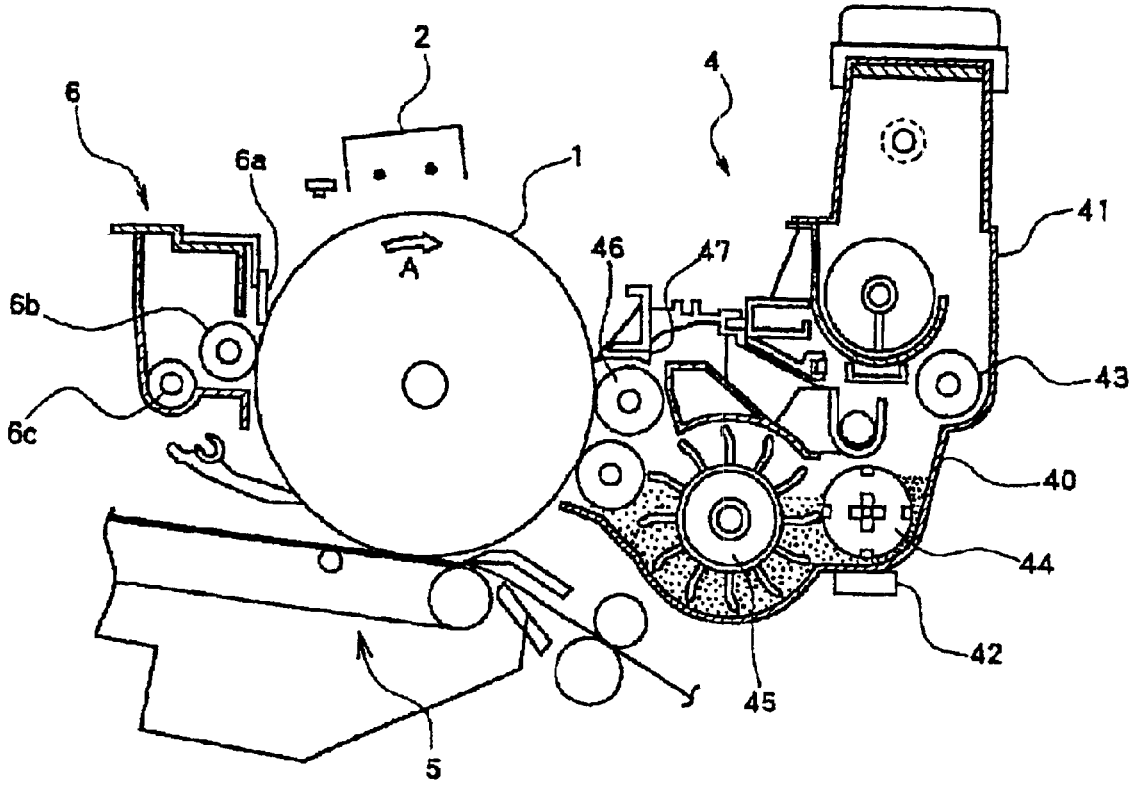
FIG. 2 is a schematic enlarged view of an essential part of the image forming apparatus.

Referring now to FIG. 1 and FIG. 2, the movement of the toner used in the image forming process will be described. The developing means 4 is a two-component developing unit and has a tank 40 containing a developer composed of a carrier and the toner. When the developing means 4 forms a toner image, the toner in the developer is consumed and the proportion thereof in the developer (toner concentration) is lowered. In order to prevent lowering of image density, when a voltage Vt corresponding to the toner concentration in the developer becomes a voltage Vref corresponding to the reference value of the toner concentration or higher (namely, when the toner concentration becomes lower than a predetermined value), toner is supplied from a toner hopper 41 to maintain the toner concentration in the developer. The toner concentration in the developer is measured by a magnetic permeability sensor 42 attached on a lower case of the developing means 4. The voltage Verf corresponding to the reference value of the toner concentration is set based on a value Vsp obtained by measuring a sample toner image (P pattern) formed on the photoconductor 1 with a photosensor. The toner supplied from the toner hopper 41 via a supply roller 43 is agitated with the carrier and triboelectrified by an agitating member 44 in the developing means 4. The developer composed of the carrier and the toner is sprinkled on a developing roller 46 by a paddle wheel 45 and attracted on the developing roller 46 by a magnet therein. The attracted developer is carried by a sleeve provided on the outer circumference of the developing roller 46 and excess developer is scraped off by a developing doctor 47. The toner in the developer transported to the side of the photoconductor 1 adheres thereto corresponding to an electrostatic latent image formed thereon by a developing bias.

The toner adhered on the photoconductor 1 through the developing process is electrostatically transferred onto a transfer paper by the transfer means 5. However, about 10% of the toner is not transferred but remains on the photoconductor 1. The untransfered toner is scraped off the photoconductor 1 by a cleaning blade 6*a* or a blush roller 6*b* of the cleaning means 6. The scraped-off toner falls down under its own weight through a discharge port 6*c* and transported to a pneumatic transporting means as recovered toner, which is then returned to the developing means 4 as recycled toner (T) through a air-toner mixture transporting tube shown by broken lines.

Some toner also adheres to a transfer belt 5*a* of the transfer unit 5 since the transfer belt 5*a* is contacted with an untransferred part or a non-image part of the photoconductor 1. Thus, there is also provided another cleaning means 11 for removing the toner adhered to the transfer belt 5*a*. The residual toner remaining on the transfer belt 5*a* is scraped off by a cleaning blade (not shown) in sliding contact therewith. The toner scraped off the transfer belt 5, which may contain foreign objects such as paper powder, is not recycled but allowed to fall down under its own weight through a discharge port and sent through a toner guide screw pipe (shown by broken lines) to a waste toner tank 12 as a recovery toner container.

In the digital copying machine shown in FIG. 1, the size of the doctor gap between a developing doctor 47 and the developing roller 46 is variable. The developing gap is adjusted to a desirable size by changing the original diameter of the photoconductor 1.

The following examples will further describe the present invention in detail. Parts are by weight.

PREPARATION EXAMPLE 1

Preparation of Carrier

Dispersion "a":

The following ingredients were charged in a homomixer and stirred for 20 minutes with the jacket temperature maintained at 30–40° C., thereby obtaining a dispersion "a".

| | |
|---|---|
| Silicon resin (Trade name: SR2410, manufactured by TORAY DAUCORNING SILICONE CORPORATION) | 600 parts |
| Toluene | 400 parts |
| Aminosilane (Trade name: SH6020, manufactured by TORAY DAUCORNING SILICONE CORPORATION) | 10 parts |
| Carbon black (Trade name: Black Perls 2000, manufactured by CABOT CORPORATION) | 12 parts |

Carrier A:

Using a ferrite powder (Trade name: F-300, manufactured by Powdertech Corporation), carrier core particles having an average diameter of 52 $\mu$m were prepared. The core particles were coated with the dispersion "a" in an amount of 20.44% by weight based on the weight of the core particles by using a coating machine (SPIRACOATER, manufactured by Okada Seiko Co., Ltd.) and then baked at 300° C. for 2 hours, thereby obtaining a carrier A covered with the above resin.

PREPARATION EXAMPLE 2

Preparation of Toner

Toner 1:

| | |
|---|---|
| Polyester resin (Mw: 7000, Tm: 110° C., acid value: 25 mgKOH/g) | 90 parts |
| Polyester resin (Mw: 80000, Tm: 143° C., acid value: 20 mgKOH/g) | 10 parts |
| Carnauba wax particles (melting point: 82° C., volume average particle diameter: 590 $\mu$m) | 5 parts |
| Carbon black (#44, manufactured by Mitsubishi Chemical Corp.) | 8 parts |
| Metal-containing azo dye Bontron S-34 | 2 parts |

A mixture of the above ingredients, which had been sufficiently stirred and blended in a Henschel mixer, was kneaded at 100–110° C. for about 30 minutes in a roll mill and then cooled to room temperature. The thus obtained kneaded mixture α was ground with a jet mill, and the ground particles were classified with an air classifier. 1.0 Parts of silica (R974, manufactured by Nippon Aerosil Co., Ltd.) and 0.5 parts of titania (T805, manufactured by Nippon Aerosil Co., Ltd.) were added per 100 parts of the classified particles. After having mixed in a Henschel mixer, the mixture was passed through a mesh to remove particles having large diameters, thereby obtaining a Toner 1 having a particle diameter distribution shown in Table 1. The Toner 1 has a main peak at 3700 in its molecular weight distribution.

TABLE 1

Particle Diameter Distribution of Toner 1

| CH | D logarithmic mean | | | N | Number distribution | Volume distribution |
|---|---|---|---|---|---|---|
| 1 | 1.26 | 1.59 | 1.41 | | 0.00 | 0.00 |
| 2 | 1.59 | 2.00 | 1.78 | | 0.00 | 0.00 |
| 3 | 2.00 | 2.52 | 2.24 | 2701 | 9.00 | 0.73 |
| 4 | 2.52 | 3.17 | 2.83 | 3915 | 13.05 | 2.13 |
| 5 | 3.17 | 4.00 | 3.56 | 5928 | 19.76 | 6.44 |
| 6 | 4.00 | 5.04 | 4.49 | 7168 | 23.89 | 15.57 |
| 7 | 5.04 | 6.35 | 5.66 | 6010 | 20.03 | 26.10 |
| 8 | 6.35 | 8.00 | 7.13 | 3277 | 10.92 | 28.47 |
| 9 | 8.00 | 10.10 | 8.98 | 858 | 2.86 | 14.91 |
| 10 | 10.10 | 12.70 | 11.31 | 125 | 0.42 | 4.34 |
| 11 | 12.70 | 16.00 | 14.25 | 17 | 0.06 | 1.18 |
| 12 | 16.00 | 20.20 | 17.96 | 1 | 0.00 | 0.14 |
| 13 | 20.20 | 25.40 | 22.63 | | 0.00 | 0.00 |
| 14 | 25.40 | 32.00 | 28.51 | | 0.00 | 0.00 |
| 15 | 32.00 | 40.30 | 35.92 | | 0.00 | 0.00 |
| 16 | 40.30 | 50.80 | 45.25 | | 0.00 | 0.00 |
| SUM | | | | 30000 | 100 | 100 |

Dn (μm): 4.57
Dw (μm): 6.53
Dn/Dw: 0.700

Toner 2:

A Toner 2 was prepared in the same manner as in the preparation of the Toner 1 except that the mixture of the ingredients was kneaded at 120–130° C. in a roll mill.

Toner 3:

A Toner 3 was prepared in the same manner as in the preparation of the Toner 1 except that the mixture of the ingredients was kneaded at 140–150° C. in a roll mill.

Toner 4:

| | |
|---|---|
| Polyester resin (Mw: 7000, Tm: 110° C., acid value: 25 mgKOH/g) | 90 parts |
| Polyester resin (Mw: 80000, Tm: 143° C., acid value: 20 mgKOH/g) | 10 parts |
| Rice wax particles (melting point: 79° C., volume average particle diameter: 600 μm) | 5 parts |
| Carbon black (#44, manufactured by Mitsubishi Chemical Corp.) | 8 parts |
| Metal-containing azo dye Bontron S-34 | 2 parts |

A mixture of the above ingredients, which had been sufficiently stirred and blended in a Henschel mixer, was kneaded at 100–110° C. for about 30 minutes in a roll mill and then cooled to room temperature. The thus obtained kneaded mixture β was ground with a jet mill, and the ground particles were classified with an air classifier. 1.0 Parts of silica (R974, manufactured by Nippon Aerosil Co., Ltd.) and 0.5 parts of titania (T805, manufactured by Nippon Aerosil Co., Ltd.) were added per 100 parts of the classified particles. After having mixed in a Henschel mixer, the mixture was passed through a mesh to remove particles having large diameters, thereby obtaining a Toner 4.

Toner 5:

| | |
|---|---|
| Polyester resin (Mw: 7000, Tm: 110° C., acid value: 25 mgKOH/g) | 90 parts |
| Polyester resin (Mw: 80000, Tm: 143° C., acid value: 20 mgKOH/g) | 10 parts |
| Carnauba wax particles (melting point: 79° C., volume average particle diameter: 250 μm) | 5 parts |
| Carbon black (#44, manufactured by Mitsubishi Chemical Corp.) | 8 parts |
| Metal-containing azo dye Bontron S-34 | 2 parts |

A mixture of the above ingredients, which had been sufficiently stirred and blended in a Henschel mixer, was kneaded at 100–110° C. for about 30 minutes in a roll mill and then cooled to room temperature. The thus obtained kneaded mixture γ was ground with a jet mill, and the ground particles were classified with an air classifier. 1.0 Parts of silica (R974, manufactured by Nippon Aerosil Co., Ltd.) and 0.5 parts of titania (T805, manufactured by Nippon Aerosil Co., Ltd.) were added per 100 parts of the classified particles. After having mixed in a Henschel mixer, the mixture was passed through a mesh to remove particles having large diameters, thereby obtaining a Toner 5.

Toner 6:

A Toner 6 was prepared in the same manner as in the preparation of the Toner 1 except that a mechanical grinder, Turbo Mill was used in the grinding process instead of the jet mill.

Toner 7:

A Toner 7 was prepared in the same manner as in the preparation of the Toner 1 except that the external additives were changed to 1.0 parts of silica (R976, manufactured by Nippon Aerosil Co., Ltd.) and 0.5 parts of alumina (RFY-C, manufactured by Nippon Aerosil Co., Ltd.) per 100 parts of the classified particles.

Toner 8:

A Toner 7 was prepared in the same manner as in the preparation of the Toner 1 except that the external additives were changed to 2.0 parts of silica (R974, manufactured by Nippon Aerosil Co., Ltd.) and 0.5 parts of titania (T805, manufactured by Nippon Aerosil Co., Ltd.) per 100 parts of the classified particles.

Toner 9:

| | |
|---|---|
| Polyester resin (Mw: 7000, Tm: 110° C., acid value: 25 mgKOH/g) | 90 parts |
| Polyester resin (Mw: 80000, Tm: 143° C., acid value: 20 mgKOH/g) | 10 parts |
| Carnauba wax particles (obtained by spray drying method, melting point: 79° C., volume average particle diameter: 250 μm) | 3 parts |
| Carbon black (#44, manufactured by Mitsubishi Chemical Corp.) | 8 parts |
| Metal-containing azo dye Bontron S-34 | 2 parts |

A mixture of the above ingredients, which had been sufficiently stirred and blended in a Henschel mixer, was kneaded at 100–110° C. for about 30 minutes in a roll mill and then cooled to room temperature. The thus obtained kneaded mixture was ground with a jet mill, and the ground particles were classified with an air classifier. 1.0 Parts of silica (R976, manufactured by Nippon Aerosil Co., Ltd.) and 0.5 parts of titania (T805, manufactured by Nippon Aerosil Co., Ltd.) were added per 100 parts of the classified particles. After having mixed in a Henschel mixer, the mixture was passed through a mesh to remove particles having large diameters, thereby obtaining a Toner 9.

Toner 10:

A Toner 10 was prepared in the same manner as in the preparation of the Toner 1 except that the external additives were changed to 1.0 parts of a silicon oil treated silica (R976 treated with dimethyl silicon oil) and 0.5 parts of titania (T805, manufactured by Nippon Aerosil Co., Ltd.) per 100 parts of the classified particles.

Toner 11:

| | |
|---|---|
| Polyester resin (Mw: 7000, Tm: 110° C., acid value: 25 mgKOH/g) | 90 parts |
| Polyester resin (Mw: 80000, Tm: 143° C., acid value: 20 mgKOH/g) | 10 parts |
| Carnauba wax particles (melting point: 82° C., volume average particle diameter: 590 μm) | 5 parts |
| Carbon black (#44, manufactured by Mitsubishi Chemical Corp.) | 8 parts |
| Zirconium salt of 3,5-di-t-butylsalicylic acid | 1 part |

A mixture of the above ingredients, which had been sufficiently stirred and blended in a Henschel mixer, was kneaded at 100–110° C. for about 30 minutes in a roll mill and then cooled to room temperature. The thus obtained kneaded mixture was ground with a jet mill, and the ground particles were classified with an air classifier. 1.0 Parts of silica (R974, manufactured by Nippon Aerosil Co., Ltd.) and 0.5 parts of titania (T805, manufactured by Nippon Aerosil Co., Ltd.) were added per 100 parts of the classified particles. After having mixed in a Henschel mixer, the mixture was passed through a mesh to remove particles having large diameters, thereby obtaining a Toner 11.

Toner 12:

A Toner 12 was prepared in the same manner as in the preparation of Toner 9 except that the mixture of the ingredients was kneaded at 85–95° C.

Toner 13:

Synthesis of Organic Fine Particle Emulsion

683 Parts of water, 11 parts of a sodium salt of sulfuric acid ester of ethylene oxide adduct of methacrylic acid (Eleminol RS-30, manufactured by Sanyo Chemical Industries), 83 parts of styrene, 83 parts of methacrylic acid, 110 parts of butyl acrylate and 1 part of ammonium persulfate were charged in a reaction vessel equipped with a poker and a thermometer and stirred at 400 rpm for 15 minutes to obtain a white emulsion. The emulsion was reacted at 75° C. for 5 hours. This was mixed with 30 parts of a 1% aqueous solution of ammonium persulfate, and the mixture was aged at 75° C. for 5 hours, thereby obtaining an aqueous dispersion of a vinyl resin (copolymer of styrene-methacrylic acid-butyl acrylate-sodium salt of sulfuric acid ester of ethylene oxide adduct of methacrylic acid). The aqueous dispersion (Fine Particle Dispersion 1) was found to have a volume average particle diameter of 0.10 μm as measured with a particle size analyzer LA-920 (manufactured by Horiba Instruments Inc.). A part of the Fine Particle Dispersion 1 was dried to isolate the resin component. The Tg of the resin component was 57° C.

Preparation of Aqueous Phase

990 Parts of water, 80 parts of the Fine Particle Dispersion 1, 40 parts of a 48.5% aqueous solution of sodium dodecyldiphenyl ether disulfonate (Eleminol MON-7, manufactured by Sanyo Chemical Industries) and 90 parts of ethyl acetate were mixed and stirred to obtain a milky liquid, which will be hereinafter designated as "Aqueous Phase 1".

Synthesis of Low Molecular Weight Polyester

220 Parts of 2 mol ethylene oxide adduct of bisphenol A, 561 parts of 3 mol propylene oxide adduct of bisphenol A, 218 parts of terephthalic acid, 48 parts of adipic acid and 2 parts of dibutyltin oxide were charged in a reaction vessel equipped with a reflux condenser, an stirrer and a nitrogen gas intake pipe and reacted at 230° C. under normal pressure for 8 hours. This was further reacted under a reduced pressure of 10 to 15 mmHg for 5 hours. To the reaction product was added 45 parts of trimellitic anhydride. The mixture was reacted at 180° C. under normal pressure for 2 hours to obtain Low Molecular Weight Polyester 1 having a number average molecular weight of 2500, a weight average molecular weight of 6700, a Tg of 43° C. and an acid value of 25.

Synthesis of Prepolymer

682 Parts of 2 mol ethylene oxide adduct of bisphenol A, 81 parts of 2 mol propylene oxide adduct of bisphenol A, 283 parts of terephthalic acid, 22 parts of trimellitic anhydride and 2 parts of dibutyltin oxide were charged in a reaction vessel equipped with a reflux condenser, an stirrer and a nitrogen gas intake pipe and reacted at 230° C. under normal pressure for 8 hours. This was further reacted under a reduced pressure of 10 to 15 mmHg for 5 hours to obtain Intermediate Polyester 1 having a number average molecular weight of 2100, a weight average molecular weight of 9500, a Tg of 55° C., an acid value of 0.5 and a hydroxyl value of 49.

411 Parts of the Intermediate Polyester 1, 89 parts of isophorone diisocyanate and 500 parts of ethyl acetate were charged in a reaction vessel equipped with a reflux condenser, a stirrer and a nitrogen gas intake pipe and reacted at 100° C. for 5 hours to obtain Prepolymer 1 having a free isocyanate content of 1.53% by weight.

Synthesis of Ketimine

170 Parts of isophorone diamine and 75 parts of methyl ethyl ketone were charged in a reaction vessel equipped with a poker and a thermometer and reacted at 50° C. for 5 hours to obtain Ketimine Compound 1 having an amine value of 418.

Synthesis of Master Batch

40 Parts carbon black (Regal 400R, manufactured by Cabot Co.), 60 parts of a binder resin (polyester resin RS-801, manufactured by Sanyo Chemical Industries, acid value: 10, Mw: 20000, Tg: 64° C.) and 30 parts of water was mixed in a Henschel mixer to obtain an aggregated mixture impregnated with water. The aggregated mixture was kneaded at 130° C. for 45 minutes in a two-roll kneader with the surface temperature of the rolls set at 130° C., and the kneaded mixture was pulverized into particles having a diameter of 1 mm with a pulverizer, thereby obtaining Master Batch 1.

Preparation of Oil Phase

378 Parts of the Low Molecular Weight Polyester 1, 110 parts of carnauba wax particles (melting point: 82° C., volume average particle diameter: 590 μm), 22 parts of CCA (salicylic acid metal complex E-84, manufactured by Orient Chemical Industries, Ltd.), 947 parts of ethyl acetate were charged in a vessel equipped with a poker and a thermometer and heated to 80° C. with stirring. This was allowed to stand at 80° C. for 5 hours and then cooled to 30° C. in 1 hour. Then, 500 parts of the Master Batch 1 and 500 parts of ethyl acetate were charged in a vessel and mixed for 1 hour to obtain Material Solution 1.

1324 Parts of the Material Solution 1 was charged in a vessel and dispersion of the carbon black and the wax was performed by passing through a beads mill (Ultraviscomill, manufactured by Aimex Co., Ltd.) filled with zirconia beads having a diameter of 0.5 mm by 80 vol. % three times under conditions of a liquid feeding rate of 1 kg/hr and a disk circumferential velocity of 6 m/sec. This was then mixed with 1324 parts of a 65% ethyl acetate solution of the Low Molecular Weight Polyester 1. The mixture was once passed through the beads mill under the same conditions as above, thereby obtaining Pigment-Wax Dispersion 1 having a solid concentration of 50% (130° C., 30 minutes).

Emulsification-Deformation-Desolvent

648 Parts of the Pigment-Wax Dispersion 1, 154 parts of the Prepolymer 1 and 6.6 parts of the Ketimine Compound 1 were charged in a vessel and mixed using T.K. Homo Mixer (manufactured by Tokushu Kika Kogyo Co., Ltd.) at 5000 rpm for 1 minute. This was then mixed with 1200 parts of the Aqueous Phase 1 using T.K. Homo Mixer at 13000 rpm for 20 minutes, thereby obtaining Emulsified Slurry 1.

The thus obtained Emulsified Slurry 1 was charged in a vessel equipped with a poker and a thermometer and desolvented at 30° C. for 8 hours and then at 45° C. for 4 hours, thereby obtaining Dispersion Slurry 1 having a weight average particle diameter of 5.95 μm and a number average particle diameter of 5.45 μm.

Washing-Drying

100 Parts of the Dispersion Slurry was filtered under a reduced pressure.

(1) The filter cake and 100 parts of ion-exchanged water were mixed using T.K. Homo Mixer (at 12000 rpm for 10 minutes), and the mixture was filtered.
(2) The filter cake obtained in (1) and 100 parts of a 10% aqueous solution of sodium hydroxide were mixed using T.K. Homo Mixer (at 12000 rpm for 30 minutes) under application of ultrasonic vibration. The mixture was then filtered under a reduced pressure. This ultrasonic and alkali washing was repeated once again.
(3) The filter cake obtained in (2) and 100 parts of a 10% hydrochloric acid were mixed using T.K. Homo Mixer (at 12000 rpm for 10 minutes). The mixture was then filtered.
(4) The filter cake obtained in (3) and 300 parts of ion-exchanged water were mixed using T.K. Homo Mixer (at 12000 rpm for 10 minutes). The mixture was then filtered. This mixing and filtering process was repeated once again, thereby obtaining Filter Cake 1.

The Filter Cake 1 was dried at 45° C. for 48 hours in a circulating air drier and then sieved using a 75 μm mesh sieve. 1.0 Parts of silica (R974, manufactured by Nippon Aerosil Co., Ltd.) and 0.5 parts of titania (T805, manufactured by Nippon Aerosil Co., Ltd) were added per 100 parts of the thus obtained particles. After having mixed in a Henschel mixer, the mixture was passed through a mesh to remove particles having large diameters, thereby obtaining a Toner 13 having a weight average particle diameter Dv of 6.03 μm and a number average particle diameter Dn of 5.52 μm.

The coefficient of dynamic friction, sphericity, loose apparent density aggregation degree and average dispersion diameter of wax of Toners 1 to 13 are summarized in Table 2.

TABLE 2

Physical Properties of Toners

| Toner | Coefficient of dynamic friction | Sphericity | Loose apparent density | Aggregation degree | Average dispersion diameter of wax |
|---|---|---|---|---|---|
| 1 | 0.28 | 0.91 | 0.33 | 33 | 1.5 |
| 2 | 0.20 | 0.91 | 0.33 | 33 | 1.7 |
| 3 | 0.15 | 0.91 | 0.32 | 34 | 2.2 |
| 4 | 0.29 | 0.91 | 0.34 | 32 | 1.3 |
| 5 | 0.32 | 0.91 | 0.35 | 31 | 0.6 |
| 6 | 0.28 | 0.94 | 0.39 | 30 | 1.5 |
| 7 | 0.28 | 0.91 | 0.38 | 31 | 1.5 |
| 8 | 0.28 | 0.91 | 0.35 | 25 | 1.5 |
| 9 | 0.39 | 0.91 | 0.37 | 29 | 0.6 |
| 10 | 0.30 | 0.91 | 0.41 | 34 | 1.5 |
| 11 | 0.27 | 0.91 | 0.33 | 33 | 1.4 |
| 12 | 0.44 | 0.91 | 0.37 | 29 | 1.1 |
| 13 | 0.45 | 0.97 | 0.45 | 22 | 0.5 |

EXAMPLE 1

A test machine was set at developing conditions summarized in Table 3-1 and a developer composed of the Toner 1 and the carrier A (toner concentration: 4.0% by weight) was charged in the test machine. Then, an endurance test for 300K sheets was conducted. The results are summarized in Table 3-2.

EXAMPLE 2

A test machine was set at developing conditions summarized in Table 3-1 and a developer composed of the Toner 2 and the carrier A (toner concentration: 4.0% by weight) was charged in the test machine. Then, an endurance test for 300K sheets was conducted. The results are summarized in Table 3-2.

COMPARATIVE EXAMPLE 1

A test machine was set at developing conditions summarized in Table 3-1 and a developer composed of the Toner 3 and the carrier A (toner concentration: 4.0% by weight) was charged in the test machine. Then, an endurance test for 300K sheets was conducted. The results are summarized in Table 3-2.

EXAMPLE 3

A test machine was set at developing conditions summarized in Table 3-1 and a developer composed of the Toner 4 and the carrier A (toner concentration: 4.0% by weight) was charged in the test machine. Then, an endurance test for 300K sheets was conducted. The results are summarized in Table 3-2.

EXAMPLE 4

A test machine was set at developing conditions summarized in Table 3-1 and a developer composed of the Toner 5 and the carrier A (toner concentration: 4.0% by weight) was charged in the test machine. Then, an endurance test for 300K sheets was conducted. The results are summarized in Table 3-2.

EXAMPLE 5

A test machine was set at developing conditions summarized in Table 3-1 and a developer composed of the Toner 6 and the carrier A (toner concentration: 4.0% by weight) was charged in the test machine. Then, an endurance test for 300K sheets was conducted. The results are summarized in Table 3-2.

EXAMPLE 6

A test machine was set at developing conditions summarized in Table 3-1 and a developer composed of the Toner 7 and the carrier A (toner concentration: 4.0% by weight) was charged in the test machine. Then, an endurance, test for 300K sheets was conducted. The results are summarized in Table 3-2.

EXAMPLE 7

A test machine was set at developing conditions summarized in Table 3-1 and a developer composed of the Toner 8 and the carrier A (toner concentration: 4.0% by weight) was charged in the test machine. Then, an endurance test for 300K sheets was conducted. The results are summarized in Table 3-2.

EXAMPLE 8

A test machine was set at developing conditions summarized in Table 3-1 and a developer composed of the Toner 9 and the carrier A (toner concentration: 4.0% by weight) was charged in the test machine. Then, an endurance test for 300K sheets was conducted. The results are summarized in Table 3-2.

EXAMPLE 9

A test machine was set at developing conditions summarized in Table 3-1 and a developer composed of the Toner 10 and the carrier A (toner concentration: 4.0% by weight) was charged in the test machine. Then, an endurance test for 300K sheets was conducted. The results are summarized in Table 3-2.

EXAMPLE 10

A test machine was set at developing conditions summarized in Table 3-1 and a developer composed of the Toner 11 and the carrier A (toner concentration: 4.0% by weight) was charged in the test machine. Then, an endurance test for 300K sheets was conducted. The results are summarized in Table 3-2.

EXAMPLE 11

A test machine was set at developing conditions summarized in Table 3-1 and a developer composed of the Toner 12 and the carrier A (toner concentration: 4.0% by weight) was charged in the test machine. Then, an endurance test for 300K sheets was conducted. The results are summarized in Table 3-2.

EXAMPLE 12

A developing unit mounting two developing rollers which were the same as the one used in Example 7 (the distance between the surfaces of the sleeves was 1.0 mm) was incorporated in a test machine and a developer composed of the Toner 8 and the carrier A (toner concentration: 4.0% by weight) was charged in the test machine. Then, an endurance test for 300K sheets was conducted. The results are summarized in Table 3-2.

EXAMPLE 13

A test machine was set at developing conditions summarized in Table 3-1 and a developer composed of the Toner 13 and the carrier A (toner concentration: 4.0% by weight) was charged in the test machine. Then, an endurance test for 300K sheets was conducted. The results are summarized in Table 3-2.

TABLE 3-1

| | Test Conditions | | | |
|---|---|---|---|---|
| | Linear speed of developer carrier (mm/sec) | Doctor gap (mm) | Developing gap (mm) | Amount of developer passing through the doctor gap |
| Ex. 1 | 660 | 0.65 | 0.75 | 12.5 |
| EX. 2 | 660 | 0.65 | 0.75 | 12.5 |
| Comp. EX. 1 | 660 | 0.65 | 0.75 | 12.5 |
| Ex. 3 | 724 | 0.65 | 0.75 | 13.8 |
| Ex. 4 | 724 | 0.65 | 0.75 | 13.8 |
| Ex. 5 | 724 | 0.4 | 0.4 | 8.5 |
| Ex. 6 | 950 | 0.7 | 0.7 | 18.1 |
| Ex. 7 | 1064 | 0.7 | 0.7 | 20.2 |
| Ex. 8 | 660 | 0.65 | 0.75 | 12.5 |
| Ex. 9 | 950 | 0.7 | 0.7 | 18.1 |
| Ex. 10 | 660 | 0.65 | 0.75 | 12.5 |
| Ex. 11 | 660 | 0.65 | 0.75 | 12.5 |
| Ex. 12 | 1064 | 0.7 | 0.7 | 20.2 |
| Ex. 13 | 1064 | 0.7 | 0.7 | 22.2 |

TABLE 3-2

| | Test Results | | |
|---|---|---|---|
| Example No. | Carrier Contamination Degree | Image Density | Surface Stain Rank |
| Ex. 1 | 29 | 1.36 | 6 |
| Ex. 2 | 38 | 1.27 | 6 |
| Comp. Ex. 1 | 51 | 1.14 | 3 |
| Ex. 3 | 25 | 1.40 | 7 |
| Ex. 4 | 14 | 1.51 | 9 |
| Ex. 5 | 24 | 1.41 | 7 |
| Ex. 6 | 22 | 1.43 | 8 |
| Ex. 7 | 21 | 1.44 | 8 |
| Ex. 8 | 9 | 1.55 | 9 |
| Ex. 9 | 20 | 1.45 | 8 |
| Ex. 10 | 19 | 1.46 | 8 |
| Ex. 11 | 5 | 1.55 | 10 |
| Ex. 12 | 22 | 1.55 | 9 |
| Ex. 13 | 5 | 1.55 | 10 |

Evaluation Method

Carrier Contamination Degree:

The toner was blown off the developer after the 300K sheets endurance test to obtain the carrier. 10 Gram of MEK (methyl ethyl ketone) was added per 1 g of the thus obtained carrier and shaken with a hand. The supernatant liquid was measured for the turbidity (%) using a turbidity meter. The contamination degree of the carrier was calculated according to the following equation:

$$\text{Carrier contamination degree (\%)} = 100 - \text{Turbidity}$$

Surface Stain:

The surface stain was ranked on a scale of 1 to 10 (10 is the best). 6 or greater is in permissible level. Rank 10 represents no surface stain.

According to the present invention, there can be provide a toner which is resistant to heat stress and mechanical stress, which does not cause contamination of a carrier, and which can produce a stable image with high image density and free from surface stain, when used in a high-speed electrographic image forming apparatus having a narrow doctor gap. According to another aspect of the present invention, there can be provided a method of producing the toner and an image forming method using a two-component developer containing the toner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2001-164364 filed May 31, 2001 and No. 2001-225006 filed Jul. 25, 2001, inclusive of the specifications, claims and drawings, are hereby incorporated by reference herein.

What is claimed is:

1. An image forming method of an oilless fixing type, comprising:

forming an electrostatic latent image on an electrostatic latent image bearable member, contacting the latent image on said image bearable member with a developer carried by a developer carrier rotating at a linear speed of 360–1,680 mm/sec, wherein the amount of the developer carried on said developer carrier is regulated by a developer regulating member extending in a lateral direction parallel to the rotational axis of said developer carrier and disposed adjacent to said developer carrier to define a gap therebetween of 0.3–1.0 mm, wherein the amount of the developer carried on said developer carrier an passing through said gap per 1 second is 5.0–25.0 g per 1 cm of the lateral width of said gap, and wherein said developer comprises carrier particles and a toner, wherein aid toner comprises toner particles each comprising a wax dispersed therein, and wherein said toner has a coefficient of dynamic friction of 0.18 to 0.45.

2. A method as claimed in claim 1, wherein said carrier particles are each covered with a silicone resin.

3. A method as claimed in claim 1, wherein said carrier particles contain an aminosilane coupling agent.

4. A method as claimed in claim 1, further comprising detecting the concentration of the toner on said latent image bearable member, and controlling the amount of the toner contained in the developer according to the detected concentration.

5. A method as claimed in claim 1, wherein said gap is 0.3–0.5 mm.

6. A method as claimed in claim 1, wherein said image bearable member and said developer carrier are disposed to define a space of 0.3–1.0 mm therebetween and wherein said developer carried by said developer carrier is brought into contact with said latent image on said image bearable member in said space.

7. A method as claimed in claim 1, further comprising contacting the latent image on said image bearable member with a developer carried by an additional developer carrier member disposed in juxtaposition to said developer carrier such that the developer carried by said additional developer carrier member may be brought into contact with the latent image on said image bearable member.

8. A device for developing a latent image on an image bearable member, comprising a developer carrier rotatable at a linear speed of 360–1,680 mm/sec and disposed such that the developer carried by said developer carrier may be brought into contact with the latent image on said image bearable member, and a developer regulating member extending in a lateral direction parallel to the rotational axis of said developer carrier and disposed adjacent to said developer carrier to define a gap therebetween of 0.3–1.0 mm, said developing device being operable so that the amount of the devoloper conveyed by said developer carrier and passing through said gap per 1 second is 5.0–25.0 g per 1 cm of the lateral width of said gap, said developer comprising carrier particle and a toner, wherein said toner comprises toner particles each comprising a wax dispersed therein and wherein said toner has a coefficient of dynamic friction of 0.18 to 0.45.

9. A device as claimed in claim 8, wherein said gap is 0.3–0.5 mm.

10. A device as claimed in claim 8, wherein said image bearable member and said developer carrier are disposed to define a space of 0.3–1.0 mm therebetween and wherein said developer carried by said developer carrier is brought into contact with said latent image on said image bearable member in said space.

11. A device as claimed in claim 8, further comprising an additional developer carrier member disposed in juxtaposition to said developer carrier such that the developer carried by said additional developer carrier member may be brought into contact with the latent image on said image bearable member.

12. A device as claimed in claim 8, wherein the wax is selected from the group consisting of rice wax, ester wax and a mixture thereof.

13. A device as claimed in claim 8, wherein said toner is obtainable by kneading and milling a composition comprising a binder resin, a colorant and wax particles having a particle diameter of 100 to 300 $\mu$m.

14. A device as claimed in claim 13, wherein the wax particles are obtainable by a spray drying method.

15. A device as claimed in claim 8, wherein the dispersed wax in said toner particle has an average particle diameter of 0.3 to 1.0 $\mu$m.

16. A device as claimed in claim 8, wherein the toner particles have sphericity of at least 0.94.

17. A device as claimed in claim 8, wherein the toner particles have loose apparent density of 0.3–0.5 g/cm$^3$.

18. A device as claimed in claim 8, wherein the toner particle comprises alumina particles on the surface thereof.

19. A device as claimed claim 8, wherein the toner particle comprises silicone oil on the surface thereof.

20. A device as claimed in claim 8, wherein the toner particle comprises, on the surface thereof, inorganic particles whose surface is treated with silicone oil.

21. A device as claimed in claim 8, wherein said toner has an aggregation degree of 30% or less.

22. A device as claimed in claim 8, wherein said toner is negatively chargeable, and wherein said toner comprises a binder resin, a colorant, and a compound containing to which at least one aromatic compound selected from the group consisting of aromatic dials, hydroxyl group-containing aromatic carboxylic acids aromatic monocarboxylic acids and chromatic polycarboxylic acids is bonded or coordinated.

23. A device as claimed in claim 8, wherein said toner is obtainable by kneading and milling a composition comprising a binder resin and a colorant at a temperature of not higher than 100° C.

24. A device as claimed in claim 8, wherein said toner is obtainable by granulating, in an aqueous medium, a composition comprising the wax and a member selected from the group consisting of binder resins and precursors of the binder resin.

25. A toner for a two-component developer, comprising:

toner particles, wherein each toner particle comprises a wax dispersed therein, wherein said toner has a coefficient of dynamic friction in the range of 0. 8–0.45, and wherein said toner forms a two-component developer with a carrier, and said toner is, as the developer, housed in an image forming apparatus which comprises:

a developer carrier rotatable at a linear speed of 360 to 1,680 mm/sec; and a developer regulating member extending in a lateral direction parallel to the rotational axis of the developer carrier, wherein the developer regulating member is disposed adjacent to the developer carrier so as to define a gap therebetween being 0.3 to 1.0 mm, and the developer carrier conveys the developer so as to define the amount of the developer passing through between the gap per 1 second being 5.0 to 25.0 g per 1 cm of the lateral width of the gap.

26. A toner as claimed in claim 25, the wax is selected from the group consisting of rice wax, ester wax and a mixture thereof.

27. A toner as claimed in claim 25, wherein said toner is a toner obtainable by kneading and milling a composition comprising a binder resin, a colorant and wax particles having a particle diameter of 100 to 300 $\mu$m.

28. A toner as claimed in claim 27, wherein the wax particle is obtainable by a spry drying method.

29. A toner as claimed in claim 25, wherein the wax has an average particle diameter of 0.3 to 1.0 $\mu$m.

30. A toner as claimed in claim 25, wherein the boner particle has sphericity of at least 0.94.

31. A toner as claimed in claim 25, where the toner particle has a loose apparent density of 0.3 to 0.5 g/cm$^3$.

32. A toner as claimed in claim 25, wherein the toner particle comprises alumina particles on the surface thereof.

33. A toner as claimed in claim 25, wherein the toner particle comprises silicone oil on the surface thereof.

34. A toner as claimed in claim 25, wherein the toner particle comprises, on the surface thereof, inorganic particles whose surface are treated with silicone oil.

35. A toner as claimed in claim 26, wherein said toner has an aggregation degree of 30% or less.

36. A toner as claimed in claim 35, where said toner comprises a binder resin, a colorant and a compound containing zirconium to which at least one aromatic compound selected from the group consisting of aromatic diols, hydoxyl group-containing aromatic carboxylic acids, aromatic monocarboxylic acids and aromatic polycarboxylic acids is bonded or coordinated, and wherein said toner is negatively chargeable.

37. A toner as claimed in claim 25, wherein aid toner is obtainable by kneading and milling a composition comprising a binder :resin and a colorant at a temperature of not higher than 100° C.

38. A toner as claimed in 25, wherein said toner is obtainable by granulating, in an aqueous medium, a composition comprising the wax and a member selected from the group consisting of binder resins and precursors of the binder resin.

* * * * *

UNITED STATES PATENT AND TRADEMARK OFFICE

CERTIFICATE OF CORRECTION

PATENT NO. : 6,887,636 B2
APPLICATION NO. : 10/158069
DATED : May 3, 2005
INVENTOR(S) : Hiroaki Matsuda et al.

It is certified that error appears in the above-identified patent and that said Letters Patent is hereby corrected as shown below:

Column 20, line 64, "there can be provide" should read -- there can be provided --.

Column 21, line 40, "wherein aid toner comprises"
should read -- wherein said toner comprises --.

Column 22, line 14, "carrier particle and a toner,"
should read -- carrier particles and a toner, --;
line 60, "consisting of aromatic dials,"
should read -- consisting of aromatic diols, --.

Column 24, line 17, "where said toner" should read -- wherein said toner --;
line 28, "a binder :resin" should read -- a binder resin --.

Signed and Sealed this

Twenty-seventh Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 6,887,636 B2
APPLICATION NO. : 10/158069
DATED : May 3, 2005
INVENTOR(S) : Hiroaki Matsuda et al.

It is certified that error appears in the above-identified patent and that said Letters Patent is hereby corrected as shown below:

In Column 23, Line 10

"the range of 0. 8-0.45, and" should read --the range of 0.18-0.45, and--.

Signed and Sealed this

Fourth Day of December, 2007

JON W. DUDAS
*Director of the United States Patent and Trademark Office*